US011420459B2

(12) United States Patent
Ellis et al.

(10) Patent No.: US 11,420,459 B2
(45) Date of Patent: Aug. 23, 2022

(54) PRINTER

(71) Applicant: VIDEOJET TECHNOLOGIES INC., Wood Dale, IL (US)

(72) Inventors: Jeremy Ellis, Nottingham (GB); Keith Buxton, Nottingham (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 812 days.

(21) Appl. No.: 16/326,415

(22) PCT Filed: Aug. 17, 2017

(86) PCT No.: PCT/GB2017/052442

§ 371 (c)(1),
(2) Date: Feb. 19, 2019

(87) PCT Pub. No.: WO2018/033745

PCT Pub. Date: Feb. 22, 2018

(65) Prior Publication Data

US 2021/0170773 A1 Jun. 10, 2021

(30) Foreign Application Priority Data

Aug. 19, 2016 (GB) ..... 1614237
Oct. 27, 2016 (GB) ..... 1618166

(51) Int. Cl.
*B41J 31/14* (2006.01)
*B41J 2/325* (2006.01)
*B41J 35/36* (2006.01)

(52) U.S. Cl.
CPC ..... *B41J 31/14* (2013.01); *B41J 2/325* (2013.01); *B41J 35/36* (2013.01)

(58) Field of Classification Search
CPC ..... B41J 31/14; B41J 35/36; B41J 2202/15; B41J 17/36; B41J 31/16; B41J 2/325; B41J 32/00
See application file for complete search history.

(56) References Cited

U.S. PATENT DOCUMENTS 4,502,057 A 2/1985 Kawano et al.
4,588,316 A 5/1986 Everett, Jr.
(Continued)

FOREIGN PATENT DOCUMENTS

CN 1595308 A 3/2005
CN 103917374 A 7/2014
(Continued)

OTHER PUBLICATIONS

PCT/GB2017/052442 International Search Report and Written Opinion, dated Oct. 27, 2017, 11 pages.
(Continued)

*Primary Examiner* — Kristal Feggins
(74) *Attorney, Agent, or Firm* — Wolter Van Dyke Davis, PLLC; Robert L. Wolter

(57) ABSTRACT

A printhead for a thermal transfer printer comprising a plurality of printing elements, each of the printing elements being configured to transfer ink from an ink carrying ribbon to a substrate, and at least one sensor arranged to sense ink carrying ribbon. The at least one sensor comprises at least one emitter arranged to emit radiation towards the ribbon and a plurality of receivers. Each of the plurality of receivers is arranged to receive a respective reflected signal reflected by the ribbon, each reflected signal is based upon radiation emitted by the at least one emitter.

19 Claims, 4 Drawing Sheets

(56) References Cited

U.S. PATENT DOCUMENTS

| | | | |
|---|---|---|---|
| 5,982,405 | A | 11/1999 | Sasaki et al. |
| 6,080,933 | A | 6/2000 | Gretz |
| 2006/0181597 | A1 | 8/2006 | Mindler |
| 2013/0215210 | A1 | 8/2013 | McNestry et al. |

FOREIGN PATENT DOCUMENTS

| | | | |
|---|---|---|---|
| CN | 105431298 | A | 3/2016 |
| JP | S58133438 | U | 9/1983 |
| JP | S6120764 | A | 1/1986 |
| JP | S61195882 | A | 8/1986 |
| JP | S61279581 | A | 12/1986 |
| JP | H02165986 | A | 6/1990 |
| JP | H02220852 | A | 9/1990 |
| JP | H02261661 | A | 10/1990 |
| JP | 02303870 | A | 12/1990 |
| JP | 07001784 | A | 1/1995 |
| JP | H09188048 | A | 7/1997 |
| JP | 2010228207 | A | 10/2010 |
| JP | 2012020489 | A | 2/2012 |
| WO | 2002062584 | A1 | 8/2002 |
| WO | 2013025746 | A1 | 2/2013 |

OTHER PUBLICATIONS

Search Report for GB1614237.4, dated Feb. 14, 2017, 6 pages.
Office Action for JP application No. 2019-510284, dated Apr. 7, 2021, 9 pages.

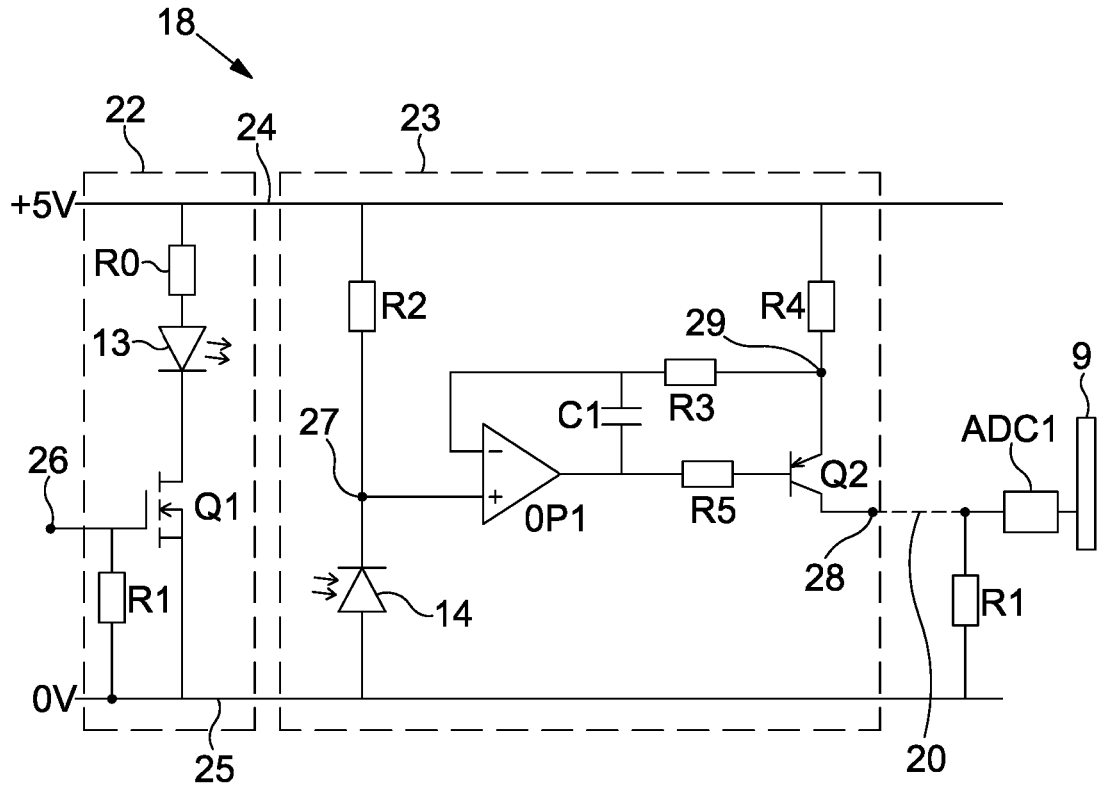
FIG. 5
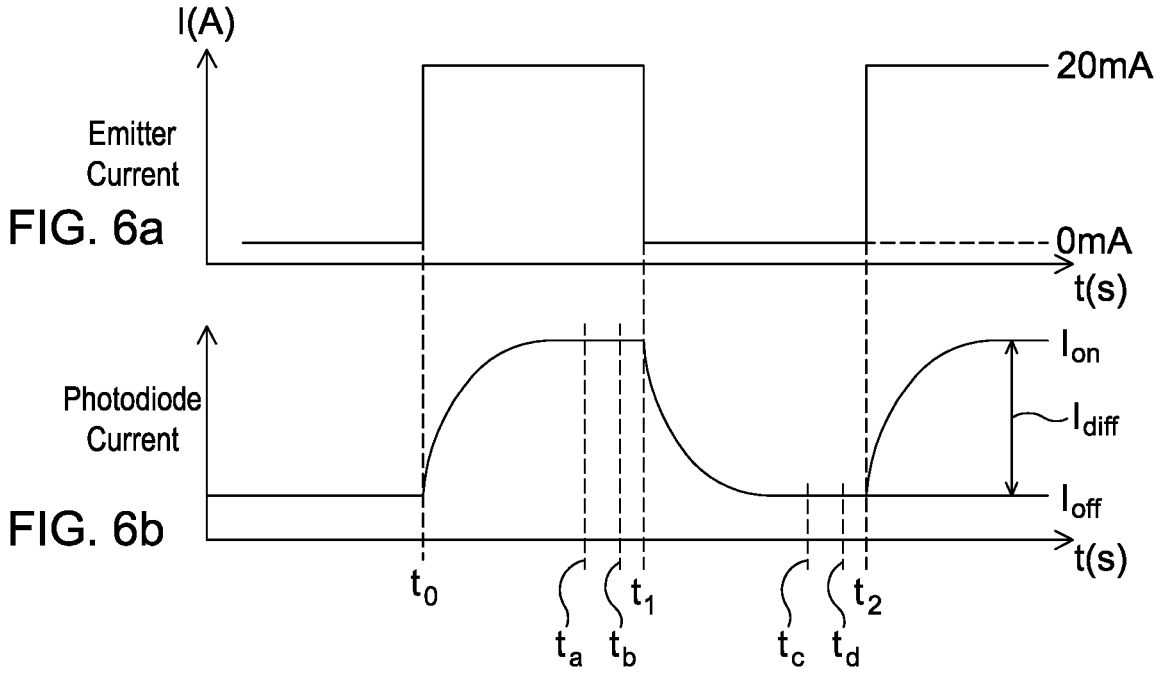
FIG. 6a
FIG. 6b

PRINTER

The present invention relates to a thermal transfer printer, and more particularly, but not exclusively to a printhead for use in a thermal transfer printer.

Thermal transfer printers use an ink carrying ribbon. In a printing operation, ink carried on the ribbon is transferred to a substrate which is to be printed. To effect the transfer of ink, the printhead is brought into contact with the ribbon, and the ribbon is brought into contact with the substrate. The printhead contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

The printing elements are generally arranged in a linear array. By causing relative movement between the printhead and the substrate on which printing is to occur, an image can be printed by carrying out a series of printing operations, each printing operation comprising the energisation of none, some or all of the printing elements to print a 'line' of the desired image before the relative movement is caused. A further 'line' is then printed in a next printing operation. A plurality of lines printed in this way together form the whole of the desired image.

Thermal transfer printers make use of single use ribbon. Thus, each printed line uses a region of ribbon which has not previously been used. Ribbon is transported past the printhead between each printing operation. Ribbon is generally provided on a spool or roll, the ribbon being transferred between a supply spool and a take up spool during printing operations. When a spool of ribbon is entirely used, printing operations are temporarily paused and a new spool is loaded into a printer. However, if printing is carried out after the end of a spool of ribbon has become detached from the supply spool, printing quality may be affected. Similarly, if printing is carried out when a portion of ribbon having no ink thereon is adjacent to the printing elements, printing quality may be affected. Moreover, during routine operation of a printer ribbon may become snapped. Continued printing after such an event may result in poor, or at least uncertain, print quality.

It is an object of some embodiments of the present invention to provide an improved printhead which allows printing operations to be carried out more reliably.

According to a first aspect of the present invention, there is provided a printhead for a thermal transfer printer. The printhead comprises a plurality of printing elements, each of the printing elements being configured to transfer ink from an ink carrying ribbon to a substrate. The printhead further comprises at least one sensor arranged to sense ink carrying ribbon.

The provision of such a sensor as part of a printhead allows direct sensing of the ribbon at a location which is extremely close to the location at which printing occurs (i.e. the location at which ink is transferred from the ribbon to the substrate). Such a sensor thus allows information regarding the ribbon to be obtained and used in control of the printer. For example, if the end of a roll of ribbon, or a snapped ribbon, is detected by the at least one sensor, it is possible to prevent any further printing operations from being carried out, preventing possible damage from occurring to the printhead, and removing uncertainty as to whether or not a portion of substrate has been printed upon.

The printhead may be arranged to generate an output associated with the ink carrying ribbon. The at least one sensor may be arranged to generate an output associated with the ink carrying ribbon.

The plurality of printing elements may, for example, comprise a linear array (i.e. the printing elements may be arranged in an array of dimension 1×N where N is the number of printing elements. The linear array may extend in a direction which, in use, is substantially perpendicular to a direction of relative movement between the ribbon and the printhead. That is, the linear array may extend in a direction substantially perpendicular to the direction of movement of the ribbon past the printhead in continuous printing operations, or the printhead past the ribbon in intermittent printing operations.

Sensing ink carrying ribbon may comprise sensing the presence or absence of ribbon.

An output of the at least one sensor may be used to control an aspect of a printer, such as, for example, preventing printing operations from being carried out when no ribbon is detected.

Sensing ink carrying ribbon may comprise sensing a property of the ribbon.

The at least one sensor may be arranged to sense a predetermined property of ribbon, such as, for example, the presence of a portion of ribbon having a predetermined property. The predetermined property may, for example, indicate that the spool from which the ribbon is being dispensed is almost entirely depleted. An output of the at least one sensor may be used to control an aspect of a printer, such as, for example, preventing printing operations from being carried out using portions of ribbon having the predetermined property, or on portions of ribbon which follow the portions of ribbon having the predetermined property.

The property may be a reflectivity of the ribbon.

The at least one sensor may be arranged to sense ink carrying ribbon at a predetermined location.

The predetermined location may be a predetermined location with respect to the printhead or a portion of the printhead. For example, the predetermined location may be at a predetermined spacing from the printhead, and/or in a predetermined direction from the printhead.

The predetermined location may be a location on a ribbon path past the printhead at which ribbon is located prior to passing the plurality of printing elements.

By providing a sensor arranged to sense ribbon at a predetermined location on a ribbon path prior to that ribbon passing the plurality of printing elements it is possible to provide an indication of a ribbon property of a portion of ribbon in advance of that portion of ribbon being used for printing (or being attempted to be used for printing).

The at least one sensor may be arranged to sense ink carrying ribbon in advance of the ink carrying ribbon passing the printing elements.

By providing a sensor arranged to sense ribbon in advance of the printing elements it is possible to provide an indication of a ribbon property in relation to a portion of ribbon in advance of that portion of ribbon reaching the printing elements, and therefore in advance of that portion of ribbon being used for printing (or being attempted to be used for printing).

The at least one sensor may comprise at least one receiver arranged to receive a signal from the ribbon.

The received signal may comprise electromagnetic radiation, such as, for example, infrared radiation. The at least one receiver may comprise a phototransistor. The at least one receiver may comprise a photodiode.

The received signal may comprise an ultrasonic signal.

By being arranged to receive a signal from the ribbon, it is meant that the received signal propagates from the ribbon to the at least one receiver. It is not intended to mean that the received signal must be generated by, or originates at, the ribbon. For example, the received signal may be reflected by the ribbon, and may then propagate to the at least one receiver.

The at least one sensor may comprise at least one emitter arranged to emit a signal towards the ribbon. The at least one sensor may comprise at least one emitter arranged to emit radiation towards the ribbon.

The emitted signal may comprise electromagnetic radiation, such as, for example, infrared radiation. The at least one emitter may comprise an LED.

The emitted signal may comprise an ultrasonic signal.

The signal may be considered to propagate towards the ribbon from the at least one emitter.

The at least one receiver may be arranged to receive a reflected signal reflected by the ribbon, the reflected signal being based upon the signal emitted by the at least one emitter.

The printhead may further comprise circuitry arranged to generate an output based upon a signal received by the at least one receiver.

The output may be based upon the amplitude of the signal received by the at least one receiver.

The circuitry may comprise an amplifier. The at least one receiver may comprise a photodiode. The amplifier may be arranged to amplify a photo-current generated by the photodiode. By providing on-printhead amplification of the received signal, it is possible to allow a signal to be provided to a controller external of the printhead.

The plurality of printing elements may be provided at an operating surface of the printhead. The sensor may be associated with the operating surface of the printhead.

The at least one sensor may be operably associated with the operating surface of the printhead. That is, in use, the at least one sensor may be associated with the same surface of the printhead upon which the printing elements are provided, so as to face the ink carrying ribbon which passes over the printing elements during printing operations. For example, the at least one sensor may be mounted upon the operating surface of the printhead.

More generally, the at least one sensor may be mounted upon the printhead such that it is operatively associated with the operating surface of the printhead. For example, a sensor may be provided below a surface of the printhead, but arranged to sense beyond the surface of the printhead. For example, an optical sensor may be separated from the surface by a transparent or translucent material while still being associated with the surface. Similarly, a magnetic sensor may be separated from the surface by a material which is penetrable by a magnetic field.

The predetermined location may be a predetermined location with respect to the operating surface of the printhead. For example, the predetermined location may be at a predetermined spacing from the operating surface of the printhead, and/or in a predetermined direction from the operating surface of the printhead.

The printhead may comprise a plurality of receivers. The at least one sensor may comprise a plurality of receivers.

Each of the plurality of receivers may be arranged to receive a respective reflected signal reflected by the ribbon. Each reflected signal may be based upon radiation emitted by the at least one emitter.

The or each sensor or may be arranged to sense ink carrying ribbon at a plurality of predetermined locations.

By providing a plurality of receivers on the printhead, it is possible to sense ribbon at a corresponding plurality of locations. As such, it is possible use a single printhead arrangement for a variety of different ribbon arrangements. For example, two receivers arranged to sense ribbon at two distinct locations allows either a wide ribbon to be sensed at the two distinct locations, or a narrow ribbon to be sensed even if it is aligned with either side of a printhead. The plurality of receivers may be provided by a respective plurality of sensors. Each of the plurality of sensors may be provided with a respective amplifier.

Each of the predetermined locations may be a location on a ribbon path past the printhead at which ribbon is located prior to passing the plurality of printing elements.

The printhead may comprise a plurality of emitters, each being arranged to emit a signal towards the ribbon. The plurality of emitters may be provided by a respective plurality of sensors. The printhead may comprise a plurality of pairs of corresponding emitters and receivers. Each of the plurality of pairs of emitters and receivers may be provided by a respective one of a plurality of sensors.

Each of the plurality of receivers may be arranged to receive a reflected signal reflected by the ribbon, the reflected signal being based upon a signal emitted by a respective one of the plurality of emitters.

The printhead may further comprise circuitry arranged to generate an output based upon a signal received by at least one of the plurality of receivers. The output may be based upon the amplitude of the signal received by at least one of the plurality of receivers.

The printhead may be arranged to generate a plurality of outputs, each of the plurality of outputs being based upon a signal received by a respective one of the plurality of receivers.

A first one of the plurality of receivers may be provided at a first location of the operating surface of the printhead, and a second one of the plurality of receivers may be provided at a second location of the operating surface on the printhead. The first and second locations may be on opposite sides of a central axis of the printhead from one another, the central axis being aligned with a direction of movement of ink carrying ribbon past the printhead. The first and second locations may be substantially symmetrically disposed about the central axis of the printhead.

The first one of the plurality of receivers may be provided proximate to a first edge of the printhead. The second one of the plurality of receivers may be provided proximate to a second edge of the printhead, the first edge being opposite to the first edge.

By proximate to a first of second edge of the printhead it is not meant that the respective receivers are necessarily provided at the respective edges of the printhead. Rather, the receivers are provided near to the respective edges of the printhead, for example, spaced apart from the respective edges of the printhead by an offset (e.g. 10 mm).

The printhead may be arranged to generate a signal indicative of a status of a spool of ribbon from which ribbon is provided for printing operations.

The status of the spool may comprise the end of the spool. For example, the signal indicative of the status of the spool of ribbon may comprise a signal indicative that the spool of ribbon has been entirely used, or is almost entirely used.

The printing elements may be heating elements which heat ink to cause the transfer of ink from the ribbon to the substrate.

According to a second aspect of the invention there is provided a thermal transfer printer comprising: first and second spool supports, respectively receiving first and second spools of ink carrying ribbon; a ribbon drive arranged to cause the transfer of ribbon between said first and second spools in a first direction; and a printhead according to the first aspect of the invention.

The thermal transfer printer may further comprise a controller. The controller may be arranged to: receive an output from the printhead: and control an operation of the printer based upon the received output.

The received output may be based upon the at least one sensor. That is, the received output may be derived directly or indirectly from an output of the at least one sensor. The received output may be generated by circuitry provided on the printhead. The received output may be an output generated by the at least one receiver. The output may comprise a plurality of output signals, each of the plurality of output signals being associated with a respective one of the plurality of receivers.

Controlling an operation of the printer based upon the received output may comprise comparing the received output with reference data.

The controller may be arranged to generate data indicative of a status of a spool of ribbon.

Reference data may comprise an expected output value. Said expected output value may be associated with a predetermined condition. The predetermined condition may comprise a presence of ribbon adjacent the sensor. The predetermined condition may comprise an absence of ribbon adjacent the sensor. Reference data may comprise a plurality of expected output values. Said plurality of expected output values may be associated with a respective plurality of predetermined conditions.

Controlling an operation of the printer based upon the received output may comprise preventing the printing elements from being controlled to attempt to transfer ink from the ink carrying ribbon to the substrate.

Controlling an operation of the printer based upon the received output may comprise: comparing the received output with reference data; and if the received output meets a predetermined criterion, performing a first action; and if the received output does not meet a predetermined criterion, performing a second action.

The first action may comprise causing the energisation of printing elements to attempt to transfer ink from an ink carrying ribbon to a substrate.

The second action may comprise preventing the energisation of printing elements to attempt to transfer ink from an ink carrying ribbon to a substrate. The second action may comprise generating an alert.

The predetermined criterion may comprise the received output having a predetermined amplitude value. The predetermined amplitude value may be associated with a predetermined condition.

The thermal transfer printer may further comprise: a camera arranged to sense electromagnetic radiation and to generate data indicative of a property of the ribbon based upon sensed electromagnetic radiation. The controller may be arranged to process data generated by the electromagnetic sensor.

The controller may be arranged to process data generated by the electromagnetic sensor based upon an output of the at least one sensor arranged to sense ink carrying ribbon.

The controller may be arranged to control the camera to capture an image of the ribbon based upon said received output. For example the controller may control the camera to capture an image in response to a predetermined characteristic of the output signal.

The predetermined characteristic of the output signal may comprise the output signal having a predetermined output value. The predetermined characteristic may comprise a signal indicative of a predetermined condition of the ribbon and/or the ribbon spool.

According to a further aspect of the invention there is provided a method of controlling a thermal transfer printer according to the second aspect of the invention.

Features discussed in the context of one aspect of the invention can be applied to other aspects of the invention. The various aspects of the invention can all be used alongside one another, for example is a single printing device.

Embodiments of the invention are now described, by way of example, with reference to the accompanying drawings, in which:

FIG. 5 is schematic view of circuitry provided on the printhead shown in FIGS. 2 to 4;

Figure 7:
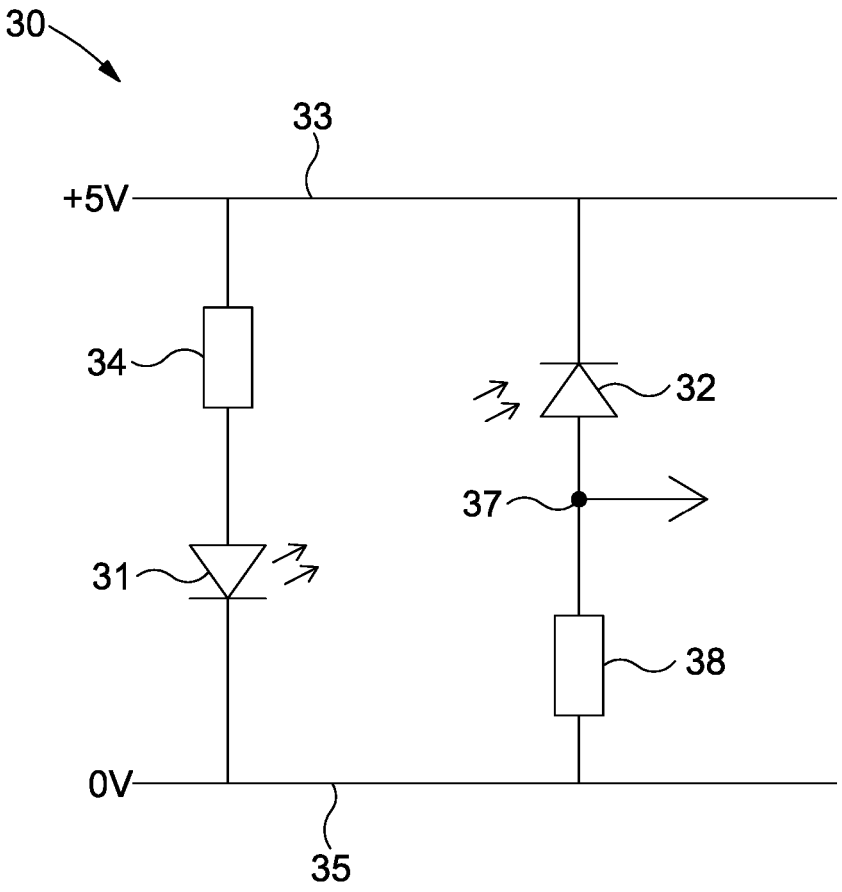

FIGS. 6*a* and 6*b* are schematic illustrations of example current waveforms in an emitter and receiver contained within circuitry of FIG. 5; and FIG. 7 is schematic view of a test circuit used to obtain reference data.

Figure 1:
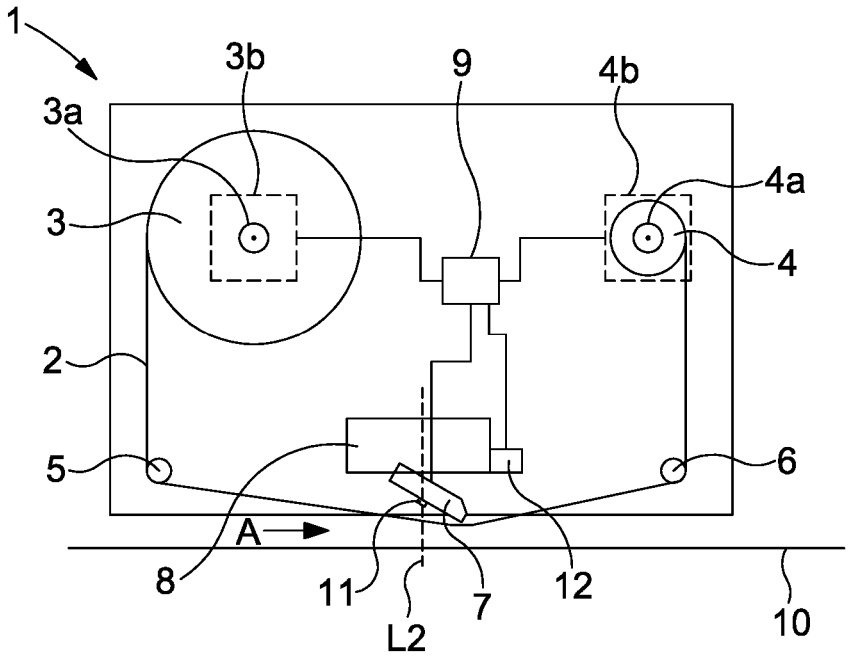
FIG. 1 is a schematic illustration of a thermal transfer printer including a printhead according to an embodiment of the invention.

Referring to FIG. 1, a thermal transfer printer 1 comprises an ink carrying ribbon 2 which extends between two spools, a supply spool 3 and a takeup spool 4. In use, ribbon 2 is transferred from the supply spool 3 to the takeup spool 4 around rollers 5, 6, past a printhead 7 mounted to a printhead carriage 8. The supply spool 3 is mounted on a spool support 3*a* which is driven by a supply spool motor 3*b*. Similarly, the take-up spool 4 is mounted on a take-up spool support 4*a* which is driven by a take-up spool motor 4*b*. Each of the supply spool motor 3*b* and the take up spool motor 4*b* are controlled by a printer controller 9. In the embodiment described here each of the supply spool motor 3*b* and the take-up spool motor 4*b* are hybrid stepper motors (as opposed to variable reluctance or permanent magnet stepper motors). The use of a hybrid stepper motor is preferred as it gives a higher resolution (typically 1.8 degrees per full step) than other types of stepper motor, and can operate at high stepping rates with excellent holding and dynamic torque capability. The stepper motor may be for example a Portescap motor having part number 34H118D30B.

While during operation the ribbon 2 is generally transferred from the supply spool 3 to the take-up spool 4, the controller 9 can also energise the motors so as to cause the ribbon 2 to be transferred from the take-up spool 4 to the supply spool 3. This can be useful in some printing modes as is described further below.

It will be appreciated that in some embodiments alternative ribbon drive apparatus may be provided as required. For example, one motor may be configured to drive the take-up spool 4, with ribbon pulled along the ribbon path.

The rollers 5, 6 may be idler rollers, and serve to guide the ribbon 2 along a predetermined ribbon path as shown in FIG. 1.

Figure 2:
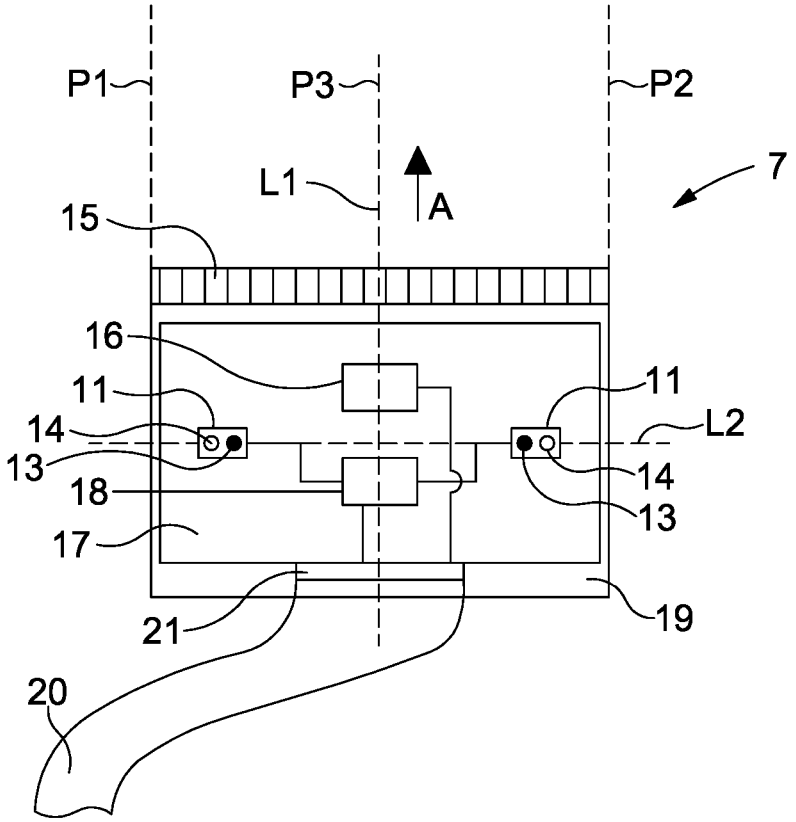
FIG. 2 is a schematic illustration of the printhead shown in the printer of FIG. 1 in more detail.
Figure 3:
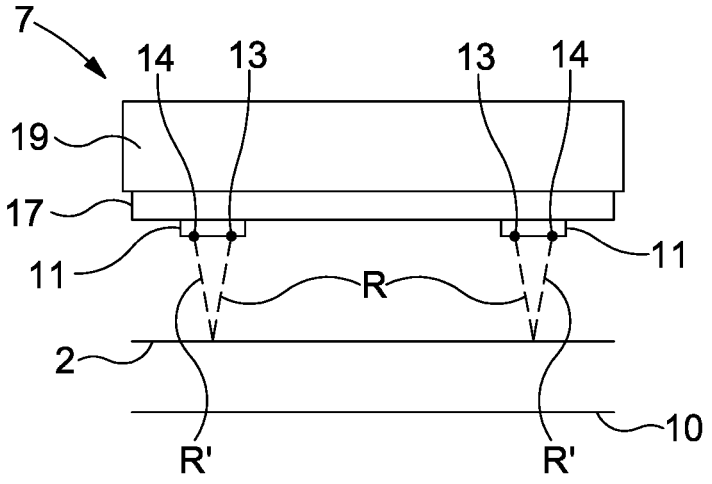
FIG. 3 is a cross-section view of the printhead shown in FIG. 2.
Figure 4:
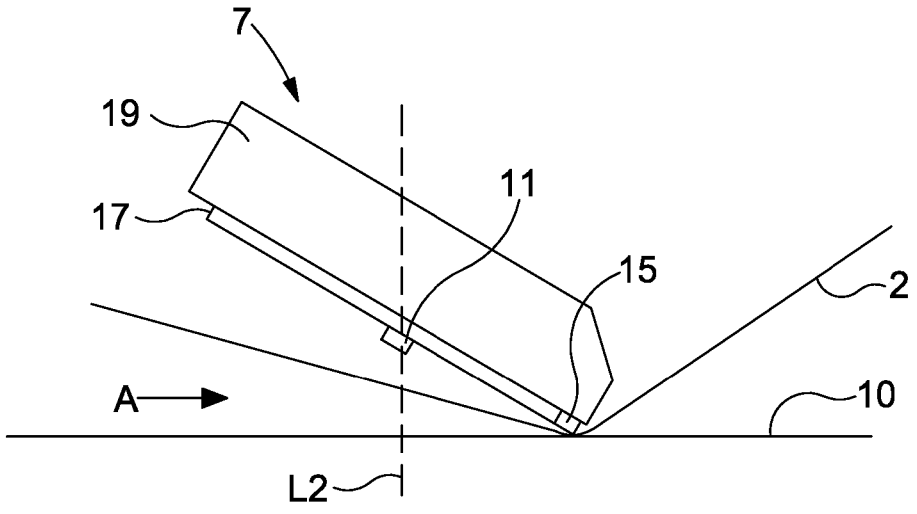
FIG. 4 is a side-view of the printhead shown in FIGS. 2 and 3.

In a printing operation, ink carried on the ribbon 2 is transferred to a substrate 10 which is to be printed on. To effect the transfer of ink, the printhead 7 is brought into contact with the ribbon 2. The ribbon 2 is also brought into contact with the substrate 10. The printhead 7 may be caused to move towards the ribbon 2 by movement of the printhead carriage 8, under control of the printer controller 9. The printhead 7 comprises printing elements 15 (as shown in FIGS. 2 to 4) arranged in a one-dimensional linear array, which, when heated, whilst in contact with the ribbon 2, cause ink to be transferred from the ribbon 2 and onto the substrate 10. Ink will be transferred from regions of the ribbon 2 which correspond to (i.e. are aligned with) printing elements 15 which are heated. The array of printing elements 15 can be used to effect printing of an image on to the substrate 10 by selectively heating printing elements which correspond to regions of the image which require ink to be transferred, and not heating printing elements 15 which require no ink to be transferred.

The printer 1 further comprises a pair of sensors 11 mounted upon the underside of the printhead 7, in the configuration shown in FIG. 1. The printer further comprises a camera 12. The camera 12 may, for example, be fixedly mounted to a housing of the printer, or to the printhead carriage 8. The printhead 7 may be a corner-edge printhead.

There are generally two modes in which the printer of FIG. 1 can be used, which are sometimes referred to as a "continuous" mode and an "intermittent" mode. In both modes of operation, the apparatus performs a regularly repeated series of printing cycles, each cycle including a printing phase during which ink is transferred to the substrate 10, and a further non-printing phase during which the printer is prepared for the printing phase of the next cycle.

In continuous printing, during the printing phase the printhead 7 is brought into contact with the ribbon 2, the other side of which is in contact with the substrate 10 onto which an image is to be printed. The printhead 7 is held stationary during this process—the term "stationary" is used in the context of continuous printing to indicate that although the printhead will be moved into and out of contact with the ribbon 2, it will not move relative to the ribbon path in the direction in which ribbon is advanced along that path. Both the substrate 10 and ribbon 2 are transported past the printhead, generally but not necessarily at the same speed.

Generally only relatively small lengths of the substrate 10 which is transported past the printhead 7 are to be printed upon and therefore to avoid gross wastage of ribbon it is necessary to reverse the direction of travel of the ribbon between printing cycles. Thus in a typical printing process in which the substrate is travelling at a constant velocity, the printhead is extended into contact with the ribbon only when the printhead 7 is adjacent regions of the substrate 10 to be printed. Immediately before extension of the printhead 7, the ribbon 2 must be accelerated up to for example the speed of travel of the substrate 10. The ribbon speed must then be maintained at the constant speed of the substrate during the printing phase and, after the printing phase has been completed, the ribbon 2 must be decelerated and then driven in the reverse direction so that the used region of the ribbon is on the upstream side of the printhead. As the next region of the substrate to be printed approaches, the ribbon 2 must then be accelerated back up to the normal printing speed and the ribbon 2 must be positioned so that an unused portion of the ribbon 2 close to the previously used region of the ribbon is located between the printhead 7 and the substrate 10 when the printhead 7 is advanced to the printing position. It is therefore desirable that the supply spool motor 3*b* and the take-up spool motor 4*b* can be controlled to accurately locate the ribbon so as to avoid a printing operation being conducted when a previously used portion of the ribbon is interposed between the printhead 7 and the substrate 10.

In intermittent printing, a substrate is advanced past the printhead 7 in a stepwise manner such that during the printing phase of each cycle the substrate 10 and generally but not necessarily the ribbon 2 are stationary. Relative movement between the substrate 10, the ribbon 2 and the printhead 7 are achieved by displacing the printhead 7 relative to the substrate and ribbon. Between the printing phases of successive cycles, the substrate 10 is advanced so as to present the next region to be printed beneath the printhead and the ribbon 2 is advanced so that an unused section of ribbon is located between the printhead 7 and the substrate 10. Once again accurate transport of the ribbon 2 is necessary to ensure that unused ribbon is always located between the substrate 10 and printhead 7 at a time that the printhead 7 is advanced to conduct a printing operation. It will be appreciated that where the intermittent mode is used, a mechanism is provided to allow the printhead 7 and the printhead carriage 8 to be moved along a linear track so as to allow its displacement along the ribbon path. Such a mechanism is not shown in FIG. 1 but one such mechanism is described in our earlier U.S. Pat. No. 7,150,572.

FIG. 2 shows the printhead 7 in more detail. As can be seen in more detail in FIG. 2, each of the sensors 11 comprises a respective emitter 13 and a respective receiver 14. Each of the emitters 13 is a radiation source, such as, for example, an LED which emits electromagnetic radiation in the infrared range. Each of the receivers 14 is provided, for example, by a photodiode. The receivers 14 are suitable for receiving the radiation emitted by the emitters 13.

The provision of emitters 13 within the sensors 11 allows the sensors 11 to operate without reliance on external components, such as, for example, an emitter which is located so as to emit radiation which is transmitted through the ribbon. Rather, the emitter can be controlled to emit radiation of a suitable type, and with appropriate modulation, to enable robust sensing of the ribbon as discussed in more detail below.

In an embodiment, the sensor 11 may suitably be provided, for example, by an analog-output reflective sensor, such as an HSDL-9100 Surface Mount Proximity Sensor manufactured by Avago Technologies, A Broadcom Limited Company, United States.

The sensor 11 is housed in a small form factor SMD package, which has a detection range of between around zero and 60 mm.

In an alternative embodiment, the sensor 11 may suitably be provided, for example, by an alternative reflective sensor in which the (or each) receiver 14 comprises a phototransistor. One such suitable component may be a QRE1113GR Surface Mount Sensor manufactured by Fairchild/ON Semiconductor, Phoenix, Ariz., United States. Such a sensor 11 may be housed in a small form factor SMD package, and may have a detection range of around 5 mm.

It will of course be appreciated that further alternative emitters and receivers may be used, provided that an appropriate combination of emitter and receiver is selected. For example, a wide-angle light source, a laser source, or other LED sources (e.g. using visible light) may also be used in the place of the emitter 13. Further, in some alternatives an ultrasonic emitter and receiver, or other forms of emitter and receiver, may be used.

Moreover, whereas in the above described embodiment the emitter 13 and receiver 14 are provided in an integrated sensor 11 mounted upon the printhead 7, in alternative embodiments the emitter and receiver may be separate devices, each mounted at different locations upon the printhead 7. Further still, different numbers of integrated sensors, or different numbers of discrete emitters and receivers may be used as appropriate. For example a single emitter may be used in combination with a pair of receivers. Alternatively, a single sensor may be used.

Further, in some embodiments sensors may be passive. That is, an emitter may be omitted entirely. In such an embodiment, a sensor is configured to sense some characteristic from the ribbon. For example, the ribbon 2 may be provided with a magnetic area which can be sensed by the sensor without the need for an emitter. Alternatively, the sensor may be a capacitive sensor, or an inductive sensor, with the ribbon being provided with a region having a characteristic which can be sensed (e.g. a metallised portion).

More generally, it will be appreciated that each of the sensors 11 are arranged to sense the ribbon 2, and that any suitable form, number, or arrangement of sensor 11 may be used.

As described briefly above, the printhead 7 further comprises a plurality of resistive heating elements 15 mounted on a ceramic substrate and which are provided in a one-dimensional linear array along a first edge of the printhead 7. The printing elements 15 are selectively energised based upon printing requirements (e.g. based upon image data). Printing control signals which are provided to the printing elements 15 may be generated within a printhead controller 16 which is mounted upon a printhead circuit board 17. A sensor interface circuit 18 is also provided on the printhead circuit board 17. The printhead circuit board 17 is attached to a heat sink 19, which also forms part of the printhead 7. The printhead controller 16 communicates with the controller 9 via a flexible ribbon cable 20 which connects to the circuit board 17 via a connector 21.

The surface of the printhead 7 which is seen in FIG. 2 is that which faces in a generally downward direction as shown in FIG. 1, and that which is provided with printing elements 15. This surface may be referred to as an operating surface of the printhead 7. The operating surface of the printhead 7, as shown in FIG. 2, generally faces the ribbon 2 in normal operation.

Thus, the sensor 11 is mounted upon the surface of the printhead 7 which, during printing operations, is arranged to face the ribbon 2, and upon which the printing elements 15 are provided, so as to face the ink carrying ribbon 2 which passes over the printing elements during printing operations.

It will, of course, be appreciated that, during printing operations, the printhead may be inclined to the ribbon by an angle which is determined by optimum print conditions. However, this angle is generally acute, for example 26°, and therefore the sensors 11 are generally considered to be facing the ribbon 2. Similarly, the ribbon 2 may be considered to be generally facing the sensors 11. Of course, it will be appreciated that during some operations of the printhead 7 during the printing cycle, such as for example when the printhead 7 is withdrawn from the printing surface between printing cycles, the printhead 7 may be inclined to the ribbon 2 by an angle which is greater than or less than that during printing operations.

More generally, it will be understood that the or each sensor may be mounted upon the printhead such that it is operatively associated with the operating surface of the printhead. For example, in some embodiments a sensor may be provided below a surface of the printhead, but arranged to sense beyond the surface of the printhead.

For example, an optical sensor may be separated from the surface by a transparent or translucent material while still being associated with the surface. Similarly, a magnetic sensor may be separated from the surface by a material which is penetrable by a magnetic field, allowing ribbon to be sensed.

As shown in more detail in FIG. 2, the printhead 7 has a centre line L1 in the direction A of the ribbon transport past the printhead 7. The sensors 11 are each offset from the centre line L1. The extent of the ribbon path as it passes the printhead 7 is indicated by dashed lines P1, P2, each of which show the edges of the ribbon. The sensors 11 are arranged symmetrically about the line L1, with each sensor 11 being disposed towards the outer edge of the full width of the linear array of printing elements 15, and thus towards the outer edge of the ribbon path. However, rather than being provided at the full extent of the ribbon, each sensor 11 is displaced inwardly from the outer extent of the printhead 7 by an offset of approximately 10 mm. The printhead 7 may, for example, have a full width of around 53 mm. Such an arrangement, as shown in FIG. 2, allows ribbon to be sensed provided it passes below the location of at least one of the sensors 11.

FIG. 3 shows an alternative view of the printhead 7 in cross-section. The cross-section is taken along a line L2 as seen in FIG. 2. L2 is also shown in FIG. 1 showing the relationship between the printhead 7 and the substrate 10. As seen in FIG. 3, the emitters 13 each emit radiation R towards the ribbon 2. The radiation R is reflected by the ribbon and beams of reflected radiation are R' are shown reflected back towards the receivers 14. It will of course be appreciated that radiation may also be emitted and reflected in other directions than just towards the receivers 14, however only those portions which are directly reflected towards the receivers 14 are shown for clarity.

It will be appreciated that different ribbon widths may be used with a single printhead. Thus, provided at least a portion of the ribbon 2 passes below at least one of the sensors 11, the ribbon 2 can be sensed. For example, a ribbon having a width which is half that of the printhead 7 can be sensed by the right most one of the sensors 11 when aligned with the right hand side of the printhead 7 in the orientation shown in FIG. 2. Such a narrower ribbon extends between lines P3 and P2 (as shown in FIG. 2). It will further be appreciated that if such a narrower ribbon is aligned with the left-hand-side of the printhead 7 so as to extend between lines P1 and P3, the left most one of the sensors 11 would be able to sense such a ribbon. Thus, the illustrated embodiment having a pair of spaced apart sensors 11 allows ribbon with a range of ribbon widths to be sensed, in a range of different configurations.

Of course, where a single sensor is provided, ribbon can be sensed when part of the ribbon passes within a sensing field of the sensor.

FIG. 4 shows a further alternative view of the printhead 7. In the arrangement shown in FIG. 4 the printhead 7 is shown in side view showing the ribbon 2 extending past the printhead 7 and contacting the printing elements 15 at the corner of the printhead 7. Furthermore, the substrate 10 is shown in contact with the ribbon 2. Such an arrangement is seen during printing operations when the printhead 7 is pressed against the substrate 10.

It will be appreciated that the ribbon 2 is advanced past the printhead 7 during printing operations so as to expose unused portions of the ribbon to the printing elements 15, allowing ink to be transferred from the ribbon to the substrate 10. The ribbon 2 moves past the printhead 7 in a particular direction. This direction is shown by arrow A in FIG. 4 (as also shown in FIGS. 1 and 2). That is, in the arrangement shown in FIG. 4, the ribbon moves from left to right past the printhead 7.

It will of course be understood that in some printing operations the printhead 7 moves with respect to the ribbon 2 (for example during intermittent printing operations). However, in continuous printing the ribbon 2 is moved past the otherwise stationery printhead 7.

Taking into account the direction A of the movement of the ribbon 2, it will be appreciated that the sensor 11 is provided before, or upstream of, the printing elements 15 as far as the ribbon 2 is concerned. That is to say, generally speaking, a portion of the ribbon 2 which passes the sensor 11 is ribbon which has not yet passed the printing elements 15. Conversely, a portion of ribbon 2 which is exposed to the camera 12 is ribbon which has passed the printing elements 15.

It will be appreciated that, during printing operations, the sensor 11 is able to sense the ribbon 2 before the ribbon has passed the printing elements of the printer 15. On the other hand, the camera 12 is only able to examine the ribbon which has already passed the printing elements 15 of the printhead 7. The camera 12 may be used for various printing related operations, such as, for example, capturing images of used ribbon and determining the quality of print by examining the amount of ink which has been removed from the ribbon 2 during a printing operation. Such operations are described in detail in our earlier patent application WO 2013/025746, which is herein incorporated by reference.

In printing operations in will be appreciated that ribbon is gradually transported from the supply spool 3 to the takeup spool 4. As such, once the entirety of a roll of ribbon has been transported from the supply spool 3 to the takeup spool 4, the ribbon will either tear off from the supply spool 3 or become taught before snapping, with the tension in the ribbon reducing to zero. Thus, at the end of a roll of ribbon, ribbon will cease passing the printhead 7, printing operations are suspended, and a new roll of ribbon is installed.

Various techniques have been employed to detect the end of ribbon in prior art printers. For example, in some printers the end of ribbon is detected by monitoring the tension in the ribbon 2. Such tension monitoring may be performed in a number of ways, such as, for example, by monitoring the power supplied to motors driving the supply and takeup spools 3, 4. Alternatively tension may be monitored by a mechanical tension monitoring means such as, for example, a dancing arm or a pressure sensor.

However, in some instances the tension monitoring may take some time to detect the loss in tension which occurs when the end of a roll of ribbon detaches from the supply spool 3. For example, a tension value which is used to indicate an end of roll event may be based upon an average of a plurality of calculated or measured tension values. Thus, an indication of an end of roll event may not be generated immediately. In such circumstances, the tail end of the roll of ribbon 2 may be drawn through the printer and may pass the printhead 7 due to continued rotation of the takeup spool 4. Thus, it may be possible that ribbon is drawn past the printing elements 15 until no ribbon is left, and the printing elements 15 are caused to attempt to print on ribbon which is not present before any loss in tension is detected. This is especially the case where long images (e.g. 300 mm) are printed, and where tension monitoring is performed between printing cycles. In such circumstances the printing elements 15 may come into direct contact with the substrate 10 and no printing may occur, or worse, damage may be caused to either of the substrate 10 or the printing elements 15. That is, where printing is carried out (or attempted to be carried out) after the end of the roll of ribbon has been reached, the print quality may be poor, or non-existent. However, importantly, the print quality may be uncertain.

The presence of the sensor 11 upstream of the printing elements 15, allows information to be gathered relating to the ribbon 2 (e.g. the presence or otherwise of ribbon). That is, by using the sensor 11 to detect the presence of ribbon at a location proximate to the sensor 11, which is upstream of the printing elements 15, it is possible to generate an early warning of an end of roll event. Similarly, the sensor 11 can be used to detect a loss of tension which may be associated with a ribbon snap or other catastrophic failure.

The operation of the sensor 11 will now be described in more detail. The radiation R emitted by the emitters 13 is directed towards and reflected by the surface of the ribbon 2 which is located adjacent to the respective sensor 11. The reflected radiation R' is received by the receivers 14. Those receivers 14 generate a signal which is indicative of the presence of ribbon 2. It will be appreciated that whether or not the ribbon is present will cause a different amount of radiation to be reflected. Thus, if there is no ribbon present a different signal will be received at the receiver. While some radiation may be reflected by the substrate 10, by use of calibration techniques it is possible to determine an expected signal which is indicative of the presence of ribbon, or the absence of ribbon. It is possible, therefore, to determine the point in time at which the tail end of a roll of ribbon passes the sensor 11. Printing can thus be halted prior to the tail end of the roll of ribbon 2 passing the printing elements 15.

Similarly, where the end of a roll of ribbon is attached to the supply spool 3 by adhesive tape, the adhesive tape may be present at the end of the roll of ribbon 2, and may interfere with the printing elements 15. However, a different reflection signature may be obtained at receivers 14 if adhesive tape is detected rather than the ribbon, or in addition to the ribbon 2. Such a reflection signature can be used to identify an end of roll event.

In some embodiments, the ribbon itself may have a portion which is of a different type towards the end of the roll of ribbon. Such a portion of ribbon 2 may be referred to as a trailer tape. The trailer tape may also be used to store information relating to various characteristics of the ribbon, or to the printer to which the ribbon relates. That is, a pattern may be provided on the trailer tape which in some way encodes data relating to the ribbon or printer. It will be appreciated that such a trailer portion may be readily identifiable with respect to the normal ribbon portion in that the trailer portion does not have ink on the surface of the ribbon 2. Further, the trailer portion may be coloured differently (e.g. silver in colour as opposed to black). The use of a sensor 11 upstream of the printing elements 15 can be used to detect the presence of the trailer tape prior to it passing or coming into contact with the heating elements 15. Thus, any damage which could otherwise be caused to the printing elements by contact with the trailer portion while trying to perform printing operations can be avoided. Moreover, any loss of printing performance which could otherwise occur, for example if printing operations were attempted to be carried out when no ink carrying ribbon was in front of the printing elements 15, this can also be avoided by the use of a sensor 11 as described above.

Moreover, once it has passed the printing elements 15 the trailer tape can be examined in more detail by the camera 12 (if present) so as to identify information from the trailer tape.

In some prior art printers, the use of trailer tape may be avoided in some circumstances. It will be understood that if trailer tape is used, but no detection is provided, there is a risk that the printer will accidentally attempt to use the trailer tape for printing operations.

It will of course be appreciated that it is common to use a header tape at the start of a roll of ribbon to identify the ribbon and various characteristics thereof. However, by providing a trailer tape it is possible to encode additional information relating to the ribbon, and to provide a more reliable source of that information. For example, where a part-roll of ribbon is installed in a printer, a header tape portion may already have been consumed. Similarly, the start of a roll of ribbon is often wound around a take-up spool during installation. Depending upon the length of ribbon used for this purpose, a header tape may have been consumed. However, a trailer tape is only accessible at the end of the roll of tape, and can thus provide a reliable source of information relating to a roll of ribbon. Such information, having been read by camera 12, may be stored in a memory location of the printer and/or used for diagnostic purposes, and/or to providing information regarding ribbon usage and performance.

As briefly described above, the amplitude of radiation received by the receiver is used to sense ribbon. That is, the amplitude of radiation received by the receiver is used to generate information relating to the type of ribbon, or the presence or absence of ribbon, at a sensing location proximate to the sensor 11.

FIG. 5 shows the sensor interface circuit 18 in more detail. The sensor interface circuit 18 is arranged to drive the emitter 13 and receive a signal from the receiver 14. The sensor interface circuit 18 is further arranged to amplify the received signal and to generate an output signal which can be provided to the printer controller 9 via the ribbon cable 20. The sensor interface circuit 18 comprises an emitter driver circuit 22 and a receiver circuit 23. While both of these circuits 22, 23, are shown in a single circuit diagram, it will, of course, be appreciated that they are effectively separate circuits, and may be independently modified.

The emitter driver circuit 22 comprises a positive supply rail 24 which is connected to a +5V voltage supply, a ground rail 25 which is connected to a ground voltage (0 V), a field effect transistor Q1, a resistor R0, and a resistor R1. The anode of the emitter 13 is connected, via the resistor R0, to the supply rail 24, with the cathode switchably connected, via the transistor Q1, to the ground rail 25. The resistor R1 is connected between the gate of the transistor Q1 and the ground rail 25. An input node 26 is provided at the gate of the transistor Q1. The input node 26 is driven, in use, by a PWM signal provided by the printer controller 9, via the ribbon cable 20.

The resistor R0 has a resistance value of 200Ω. The resistor R0 is provided so as to control the current flowing through the emitter 13 when the cathode of the emitter 13 is connected to the ground rail 25 by the transistor Q1. In the described embodiment, assuming a voltage drop of approximately 1 V across the emitter 13, a voltage drop of approximately 4 V will be developed across the resistor R0. This configuration (i.e. a voltage of 4 V being developed across a resistor R0 having a resistance value of 200Ω) will cause a drive current of approximately 20 mA to flow through the emitter 13.

The resistor R1 has a resistance value of 10 kΩ. The resistor R1 is provided so that if the print head is not connected to the ribbon cable (for example during transit), or is driven from a switching source that may be tri-stated (i.e. a high-impedance state, in addition to '1' and '0'), then the gate of the transistor Q1 will not be allowed float, and will thus be less susceptible to ESD damage.

The transistor Q1 is an n-channel FET, and may be provided, for example, by a 2N7002 device as manufactured by NXP Semiconductors, Eindhoven, The Netherlands. The transistor is driven by the PWM signal which switches between a high (e.g. 5 V) level and low (e.g. 0 V) level. The PWM signal switches the transistor Q1 on and off, and in turn causes current to flow in the emitter 13 when the transistor is turned on, and causes no current to flow in the emitter 13 when the transistor is off. The PWM duty cycle may be around 50%, with a square wave profile, and a 5 kHz modulation frequency. When driven in the 'on' state, the emitter 13 has a drive current of around 20 mA. The emitter drive current level is chosen so as to not over-dissipate the emitter diode if the PWM signal should fail, and the diode is continuously driven on. The emitter device described above (HSDL-9100) has a maximum diode current of 100 mA (at an ambient temperature of 25 deg. C.), thus the selected drive current (e.g. 20 mA) is well below this maximum level. It will, of course, be appreciated that different drive levels may be selected (and that an appropriate value resistor may be chosen for the resistor R0).

The modulation frequency is selected so as to provide a fast sensor response, while not being too high such that the receiver and associated circuitry cannot respond (as described in more detail below with reference to the receiver circuit).

The receiver circuit 23 also makes use of the positive supply rail 24, and the ground rail 25. It will be appreciated, however, that separate power supply arrangements may be provided if required.

The receiver circuit 23 further comprises the receiver 14 and a resistor R2 connected between the cathode of the receiver 14 and the positive supply rail 24. A node 27 is formed between the receiver 14 and the resistor R2. The anode of the receiver 14 is connected directly to the ground rail 25. Thus, the receiver 14 is reverse biased. The resistor R2 has a resistance value of 100 kΩ. The resistor R2 and receiver 14 are thus connected in series, with any photocurrent generated within the photodiode flowing through the resistor R2, and causing a voltage drop to develop across the resistor R2.

The receiver circuit 23 further comprises an operational amplifier (op-amp) OP1. The op-amp OP1 may, for example, be provided by CMOS operational amplifiers with low noise, rail-to-rail inputs/outputs optimized for low-power, single-supply applications such as an OPA322 device manufactured by Texas Instruments, Texas, United States. For example, the op-amp OP1 may suitably be an OPA322AIDBVR device.

The node 27 is connected to a non-inverting input of the op-amp OP1. The op-amp OP1 is arranged to form a current amplifier, amplifying the photo-current flowing in the receiver 14. In addition to the op-amp OP1, the current amplifier comprises a capacitor C1, resistors R3, R4 and R5, and a transistor Q2.

The capacitor C1 is connected between the output of the op-amp OP1 and the inverting input of the op-amp OP1. The capacitor C1 has a capacitance value of 22 pF, and is provided to stabilise the op-amp OP1.

The output of the op-amp OP1 is also connected, via the resistor R5 to a base terminal of the transistor Q2. The transistor Q2 is a high gain PNP transistor in which the collector current and the emitter current are substantially equal. The transistor may, for example, be provided by a BC856B general purpose transistor, as manufactured by NXP Semiconductors. Given the high-gain of the transistor Q2, only a small current will flow into the base via the resistor R5. The resistor R5 has a resistance value of 1 kΩ, which is selected. The resistance of the resistor R5 is selected in order to limit any transient current out of the op-amp OP1 if there is a sudden change in receiver current level. It will be appreciated, therefore, that this value is not critical to the working of the amplifier circuit, and that the circuit will work over a large range of resistance values of resistor R5.

A collector terminal of the transistor Q2 is coupled to an output node 28, which is in turn coupled to an input of the printer controller 9 via the ribbon cable 20 (as described in more detail below).

An emitter terminal of the transistor Q2 is coupled, via the resistor R4, to the positive supply rail 24. A node 29 is formed between the emitter terminal of the transistor Q2 and the resistor R4. The node 29 is connected, via the resistor R3, to the inverting input of the op-amp OP1. The resistor R3 has a resistance value of 100 kΩ. This resistor is selected so as to provide substantially equal input impedance to both inputs of the op-amp OP1, so as to negate any offset due to bias current. In the arrangement described above, the non-inverting input of the op-amp OP1 is connected to the resistor R2 and the receiver 14, and will thus only have a small current flowing though it (e.g. a few micro amps). Given this small level of current, the input impedance matching is not critical, especially given the low bias current of the selected operational amplifier.

The resistor R4 has a resistance value of 100Ω. The resistance of the resistor R4 is selected, in combination with the resistance of the resistor R2, to set the current gain of the amplification circuit. In particular, the ratio of the resistances of resistors R2 and R4 determines the current gain. Thus, a resistance of 100Ω for R4, coupled with a resistance of 100 kΩ for R2, provides a current gain of around 1000.

Moreover, the resistor R4 is selected so as to ensure that across an operating range of the receiver 14, the voltage drop across the resistor R4 is maintained within a range determined by the voltage supply level (e.g. 5V). This ensures that the output of the amplifier is not saturated. The resistance of resistor R4 is sufficiently small that a convenient output current level is generated for detection at the ADC1. For example, if a current output level of 3 mA is expected, it will be appreciated that this corresponds to a voltage drop of 0.3 V across the resistor R4, and allows a voltage drop of around 4.6 V to be developed across the resistor R6 at the input to the ADC1 (assuming a collector-emitter voltage in transistor Q2 of around 0.1 V).

The op-amp OP1 is provided with positive and negative power supply connections from the positive and ground rails 24, 25 respectively. A capacitor (e.g. 0.1 μF) may be provided between the power supply terminals so as to provide supply de-coupling (i.e. to reduce supply noise).

The op-amp OP1 is configured such that if the voltage at the node 29 (which is connected, via the resistor R3, to the inverting input) exceeds the voltage at the node 27, the output of the op-amp OP1 will be driven low. Driving the output of the op-amp OP1 low will cause the transistor Q2 (which is an PNP transistor) to be turned on. This will in turn cause a current to flow through the resistor R4, and a voltage drop to develop across the resistor R4. Thus, the voltage at the node 29 will drop, until it is the same as that at node 27. The current caused to flow through the resistor R4 varies based upon the photo-current, but is significantly larger in magnitude than the photo-current (i.e. the photo-current is amplified).

In this way, the receiver circuit is arranged to amplify a small (e.g. μA level) photo-current) by around one thousand times (to mA level), allowing the receiver signal to be provided to the printer controller 9 via the ribbon cable 20. Such amplification significantly improves the noise immunity.

At the printer controller 9, the amplified current signal is provided to an input of an analog-to-digital convertor ADC1. The input is also connected to ground via a resistor R6. The resistor R6 has a value of 390Ω, and allows the amplified current signal to be converted to a voltage level.

FIG. 6 shows an example waveform of the currents flowing in the emitter 13 and receiver 14 during operation. FIG. 6*a* shows an emitter current waveform. At time t0 the current rises from 0 mA to around 20 mA (under the control of the PWM signal). Then at a time t1, the current falls from 20 mA to 0 mA (again, under the control of the PWM signal). At a time t2, the current again rises. In this way, the emitter current is pulsed on and off, causing the radiation emitter by the emitter 13 to be pulsed.

FIG. 6*b* shows a corresponding current waveform for the receiver 14 (or photodiode). The current rises at time t0 to a level $I_{ON}$. It will be appreciated that the rise is not instantaneous, and that the current gradually rises, before stabilising at the level $I_{ON}$. Then, at a time t1, the current falls from the level $I_{ON}$ to a level $I_{OFF}$. The current again falls gradually, and stabilises at the level $I_{OFF}$. The current then rises again at time t2, and so on. The rise and fall in receiver current follows the above described rise and fall in emitter current.

The current level $I_{ON}$ level is indicative of the intensity of radiation received at the receiver 14, and represents an 'on' state. The current level $I_{ON}$ corresponds to radiation comprising the reflected radiation R' which originates from the emitter 13, and also ambient radiation, being incident upon the receiver 14. It will be appreciated that the ambient radiation level will vary between various printer configurations.

The current level $I_{OFF}$ level is indicative of the intensity of radiation received at the receiver 14, and represents an 'off' state. The current level $I_{OFF}$ corresponds to only ambient radiation being incident upon the receiver 14, and does not include any reflected radiation R' which originates from the emitter 13.

The receiver current level is provided to the ADC1 via the amplification circuitry described above (i.e. the receiver circuit 23), and is then sampled by the printer controller 9. By sampling the voltage provided to the controller 9 by the ADC1, a measure of the receiver current (as shown in FIG. 6*b*) can be obtained. However, in order to provide an accurate current level, the ADC1 is sampled over a sampling period (rather than at a single sampling time).

Further, it will be appreciated that to determine an accurate measure of the receiver current level (and thus an indication of the intensity of incident radiation), the current level should be sampled towards the end of each cycle, where the current level is substantially stable.

Thus, the ADC1 is caused to begin conversion at a time $t_a$, and the ADC output voltage is sampled at a time $t_b$, shortly after the time $t_a$. As can be seen from FIG. 6*b*, both times $t_a$ and $t_b$ occur within a relatively flat and stable portion of the current waveform, allowing an accurate representation of the current level during an 'on' state to be obtained.

Similarly, to obtain an accurate representation of the current level during an 'off' state, the ADC1 is caused to begin conversion at a time $t_c$, and the ADC output voltage is sampled at a time $t_d$, shortly after the time $t_c$. Both times $t_c$ and $t_d$ occur within a relatively flat and stable portion of the current waveform.

In this way, the controller 9 is able to obtain voltage measurements $V_{on}$ and $V_{off}$ which are representative of the current levels $I_{on}$ and $I_{off}$. By subtracting $V_{off}$ from $V_{on}$ it is possible to obtain a voltage level $V_{diff}$ which is representative of a photocurrent $I_{diff}$ received at the receiver as a result of reflection of radiation emitted by the emitter 13. The voltage level $V_{diff}$ varies based upon the reflectively of the ribbon (or substrate etc.) which is adjacent to the sensor 11. The voltage level $V_{diff}$ may then be compared with one or more reference voltages, so as to identify the presence (or absence) or ribbon adjacent the sensor (as described in more detail below).

The PWM frequency of 5 kHz used in this example is also the frequency with which sensor measurements are obtained (the ADC sampling rate being determined by the PWM frequency). It will be understood that the sampling frequency will also determine how much ribbon has passed the sensor 11 between subsequent readings. For example, with a ribbon speed of 1 m/s, a sampling rate of 5 kHz provides measurement intervals of 0.2 mm. That is, between each sensor measurement, the ribbon will have advanced just 0.2 mm past the sensor 11. Thus, the end of a roll of ribbon, or a broken ribbon, can be detected far more quickly than would be the case if detection could only take place between the printing of images.

The use of a PWM frequency of 5 kHz is descried above. This may be suitable for a particular arrangement, However, as can be understood from the waveforms shown in FIG. 6*b*, if the current rise time is such that during an 'on' or 'off' period the current has not reached a stable value, it may be necessary to reduce the pulse rate accordingly. The response time is, to some extent, controlled by a junction capacitance of the photodiode (which is in turn affected by the reverse bias applied to the diode), and the resistor R2 (which, in this example has a resistance of 100 kΩ).

It will, of course, be understood that the above described circuitry provides one possible implementation. However, the skilled person will readily appreciate that alternative emitter driver and receiver circuits may be used as appropriate for a particular application, or to accommodate an alternative sensor arrangement.

For example, where a phototransistor device is used in place of the photodiode described above, the circuitry may be modified so as to provide suitable drive and detection signal levels. It will be appreciated that the phototransistor collector may be connected to the node 27 and the emitter to the ground rail 25 (i.e. 0 V). In particular, where the sensor is a QRE1113GR device, the circuit described above may be modified such that the resistor R0 has a resistance value of 200Ω, the resistor R2 has a resistance value of 1 kΩ, and the resistor R3 has a resistance value of 1 kΩ (with other components remaining as described above). Such an arrangement results in the op-amp OP1 having a reduced current gain of around 10 (rather than 1000). However, the phototransistor device itself provides higher sensitivity than the photodiode described above and may thus generate a higher current output for the same radiation intensity. Further, the phototransistor device may have a lower sensor bandwidth than the photodiode configured as described above, and thus the PWM frequency may be reduced (e.g. to 3 kHz) so as to ensure that the phototransistor can provide an appropriate response to the pulsed drive signal.

Further, in some embodiments, for example where there is negligible ambient radiation, the emitter may be constantly driven, rather than being pulsed. In such an arrangement, the ADC may be sampled at any convenient frequency. Further, the ADC may be provided as a separate device to the controller 9, or a part of the controller 9.

It will also be understood that while above descried circuitry provides driving and amplification for a single sensor (i.e. a single emitter and a single receiver) multiple circuits may be provided as required.

Prior to the controller 9 generating information relating to the ribbon, calibration may be carried out in order to determine signal levels which can be considered to be indicative of a number of distinct ribbon conditions. That is, in use, measured data (as provided by the output of the sensor 11 and/or the sensor interface circuit 18) can be compared with reference data in order to identify various predetermined conditions. For example, the ribbon may have a low reflectance, and thus may produce a lower signal level than a substrate (e.g. a white substrate). The reference data may be determined by calibration, as described in more detail below.

FIG. 7 shows a test circuit 30 used to obtain test calibration data. In the test circuit 30 an emitter 31 and receiver 32 are provided by a single device, which is a surface-mount proximity sensor of the type described above with reference to FIG. 3. An anode of the emitter 31 is connected to a +5V voltage supply rail 33 by a series connected resistor 34, with the cathode of the emitter 31 being connected to a ground rail 35. The resistor 34 has a resistance value of 200Ω, resulting in a drive current of approximately 20 mA flowing through the emitter 31. The anode of the receiver 32 is directly connected to the +5V voltage supply rail 33, while the cathode of the receiver 32 is connected to the ground rail 35 via a resistor 36. The receiver 32 is thus reverse biased. The resistor 36 has a resistance value of 110 kΩ.

A voltage is measured at a node 37 which is formed between the cathode of the receiver 32 and the resistor 36. This voltage may be measured by a high impedance probe, such as, for example, a probe provided by an oscilloscope.

When connected to printhead of a printer, for example as described above with reference to FIG. 1, the voltage at the node 37 was measured in a number of different conditions.

In a first condition in which a black ribbon was placed in front of the sensor 11, a voltage V1 of 14 mV was measured.

In a second condition in which a portion of silver trailer tape was placed in front of the sensor 11, a voltage V2 of 280 mV was measured.

In a third condition in which a no ribbon was present, and the sensor 11 was able to sense a white substrate, a voltage V3 of 112 mV was measured.

In a fourth condition in which a portion of transparent trailer tape was placed in front of the sensor 11, with a white substrate material behind the trailer tape, a voltage V4 of 167 mV was measured.

In a fifth condition in which a no ribbon was present, and the sensor 11 was able to sense a black platen, a voltage V5 of 12 mV was measured.

It will thus be appreciated that it is possible to distinguish between the presence or absence of ribbon, and also the type of ribbon present in front of the sensor 11 by taking appropriate measurements from the sensor and then comparing the measured values to reference data. The reference data may be calibration data.

Of course, the actual signal levels obtained will depend upon various other factors, such as, for example, the emitter intensity, sensor orientation, material reflectivity, separation between sensor and sensed material, amplification applied to the receiver and so on. However, the sensor interface circuit 18 described above, can be used to obtain such calibration data for a particular printer configuration. Alternatively, calibration data can be obtained using an appropriate test configuration, and stored in a memory location associated with the controller 9, allowing the controller 9 to process received signal data so as to generate information relating to the material present in front of the sensor.

During use, the measured signal level can be monitored so as to sense the end of ink carrying ribbon and the start of reflective (or transparent) trailer tape, or that no ribbon was present (and that a substrate was seen by the sensor). Appropriate action can then be taken by the printer controller 9. For example, in some embodiments, the printer controller 9 causes printing to stop once an end of roll has been detected. Alternatively or additionally, the printer controller 9 may alert a host machine (which controls the substrate movement) that printing has stopped, and may also cause such a host machine to stop substrate movement. The printer controller 9 may generate a user alert indicating to a user that an end of roll has been detected and/or that printing has been stopped.

In some instances it is known to generate an indication of the presence or absence of ribbon based upon a separate ribbon sensor. However, such a ribbon sensor is typically disposed somewhere within the printer other than on the printhead. Further, it will be appreciated that such a sensor requires additional wiring and contacts and control by the controller 9. However, by providing the sensor 11 as part of a printhead 7 it is possible to ensure that the sensor is in a convenient place to sense the ribbon in close proximity to the printhead 7 and in particular printing elements 15. More particularly, the sensor can be provided in a location that provides a sensing field which has a fixed relationship with the printing elements 15, which sensing field is upstream of the printing elements 15. In particular, the proximity of the sensor 11 to the printing element 15 can provide a reliable indication of the status of the ribbon adjacent to the printing elements 15, and thus reduces the likelihood of a snapped ribbon or end of reel occurring and not being identified prior to the end of ribbon (whether the end is the end of a roll, or the end of a broken ribbon) passing the printing elements 15.

Moreover, by using a reflective sensor which includes an active emitter, it is possible to control the illumination, so as to provide robust ribbon detection, rather than relying on other (e.g. external to the printhead) radiation sources. Further still, the use of a reflective (as opposed to transmissive) sensor provides a degree of insensitivity to features of the ribbon such as, for example, the colour or presence of ink on the ribbon or the thickness of the ribbon. For example, where a transmissive sensor is used, regions of ribbon from which ink has been removed (e.g. if ribbon is being re-used, or has been rewound between printing operations) may appear similar in appearance to regions where there is no ribbon present.

It will be understood that, in some arrangements, radiation emitted by an emitter mounted on the printhead may pass directly to the receiver (as well as being reflected by the ribbon). Such a directly received radiation may be incorrectly interpreted by the receiver (or a controller which processes an output signal received from the receiver) as a reflection signal. In some embodiments, a shield may be placed between the emitter and receiver, so as to prevent any such "cross-talk". On the other hand, in some embodiments, a sensor may be arranged such that the receiver and/or emitter are inherently shielded from one another, thereby preventing, or at least reducing, cross-talk.

In general, it will be understood that physical shielding may be provided if required to block a direct signal path between emitter and receiver. Moreover, the presence of lenses (or other transmissive optical elements around the emitter and receiver) may increase the need for shielding, for example by increasing the effective field of view of the receiver, and/or the spread of the radiation beam of the emitter. A suitable sensor can be selected based upon the particular requirements of a sensing application, such as, for example, the separation between the printhead and the ribbon at the sensor location.

It will be appreciated that where a plurality of sensors are referred to in the above description, a single sensor may be used instead. Similarly, where a single sensor is referred to, a plurality of sensors may be used if more appropriate. Moreover, while some portions of the above description refer to a single sensor (e.g. the description of the sensor interface circuit 18), it will be appreciated that this is for clarity, and that there is no intention to limit the apparatus and techniques described to a particular number of sensors.

The printer controller 9 and printhead controller 16 have been described above. It will be appreciated that the printer controller 9 and printhead controller 16 can take any suitable form (e.g. they may be programmable microprocessors in communication with a memory storing appropriate instructions, or may comprise bespoke hardware elements such as an ASIC). It will be appreciated that the printer controller 9 and printhead controller 16 may be provided by a plurality of discrete devices. As such, where functions have been attributed to the printer controller 9 or the printhead controller 16, it will be appreciated that such functions can be provided by different devices which together provide the printer controller 9 and printhead controller 16.

While various embodiments of the invention have been described above, it will be appreciated that various modifications can be made to the described embodiments without departing from the spirit and scope of the present invention.

The invention claimed is:

1. A printhead for a thermal transfer printer comprising:

a plurality of printing elements, each of the printing elements being configured to transfer ink from an ink carrying ribbon to a substrate; and at least one sensor arranged to sense ink carrying ribbon, the at least one sensor comprising at least one emitter arranged to emit radiation towards the ribbon and a plurality of receivers, each of the plurality of receivers being arranged to receive a respective reflected signal reflected by the ribbon, each reflected signal being based upon radiation emitted by the at least one emitter; and circuitry arranged to drive the at least one emitter and receive a signal from at least one of the plurality of receivers, wherein the circuitry comprises an amplifier which is arranged to amplify the signal received from the at least one of the plurality of receivers and to generate an output based upon the amplified signal for supplying to a controller of the thermal transfer printer.

2. A printhead according to claim 1, wherein sensing ink carrying ribbon comprises sensing the presence or absence of ribbon.

3. A printhead according to claim 1, wherein sensing ink carrying ribbon comprises sensing a property of the ribbon.

4. A printhead according to claim 1, wherein the at least one sensor is arranged to sense ink carrying ribbon at a plurality of predetermined locations.

5. A printhead according to claim 4, wherein each of the predetermined locations is a location on a ribbon path past the printhead at which ribbon is located prior to passing the plurality of printing elements.

6. A printhead according to claim 1, wherein the at least one sensor comprises a plurality of emitters, each one of the plurality of emitters being arranged to emit a respective signal towards the ribbon.

7. A printhead according to claim 6, wherein each of the plurality of receivers is arranged to receive a reflected signal reflected by the ribbon, the reflected signal being based upon a signal emitted by a respective one of the plurality of emitters.

8. A printhead according to claim 1, wherein the output is based upon the amplitude of the signal received by at least one of the plurality of receivers.

9. A printhead according to claim 1, wherein:

the plurality of printing elements are provided at an operating surface of the printhead; and the at least one sensor is associated with the operating surface of the printhead.

10. A printhead according to claim 9, wherein a first one of the plurality of receivers is provided at a first location of the operating surface of the printhead, and a second one of the plurality of receivers is provided at a second location of the operating surface on the printhead, the first and second locations being on opposite sides of a central axis of the printhead from one another, the central axis being aligned with a direction of movement of ink carrying ribbon past the printhead.

11. A printhead according to claim 10, wherein the first one of the plurality of receivers is provided proximate to a first edge of the printhead, and the second one of the plurality of receivers is provided proximate to a second edge of the printhead, the first edge being opposite to the first edge.

12. A printhead according to claim 1, wherein the printhead is arranged to generate a signal indicative of a status of a spool of ribbon from which ribbon is provided for printing operations.

13. A thermal transfer printer comprising:

first and second spool supports, respectively receiving first and second spools of ink carrying ribbon;

a ribbon drive arranged to cause the transfer of ribbon between said first and second spools in a first direction; and a printhead, the printhead comprising:

a plurality of printing elements, each of the printing elements being configured to transfer ink from the ink carrying ribbon to a substrate;

at least one sensor arranged to sense ink carrying ribbon, the at least one sensor comprising at least one emitter arranged to emit radiation towards the ribbon and a plurality of receivers, each of the plurality of receivers being arranged to receive a respective reflected signal reflected by the ribbon, each reflected signal being based upon radiation emitted by the at least one emitter; and circuitry arranged to drive the at least one emitter and receive a signal from at least one of the plurality of receivers, wherein the circuitry comprises an amplifier which is arranged to amplify the signal received from the at least one of the plurality of receivers and to generate an output based upon the amplified signal for supplying to a controller of the thermal transfer printer.

14. A thermal transfer printer according to claim 13 further comprising a controller, the controller being arranged to:

receive an output from the printhead; and control an operation of the printer based upon the received output.

15. A thermal transfer printer according to claim 14, wherein controlling an operation of the printer based upon the received output comprises comparing the received output with reference data.

16. A thermal transfer printer according to claim 14, wherein controlling an operation of the printer based upon the received output comprises preventing the printing elements from being controlled to attempt to transfer ink from the ink carrying ribbon to the substrate.

17. A thermal transfer printer according to claim 14, wherein controlling an operation of the printer based upon the received output comprises:

comparing the received output with reference data; and if the received output meets a predetermined criterion, performing a first action; and if the received output does not meet a predetermined criterion, performing a second action.

18. A thermal transfer printer according to claim 13, further comprising:

a camera arranged to sense electromagnetic radiation and to generate data indicative of a property of the ribbon based upon sensed electromagnetic radiation;

wherein the controller is arranged to process data generated by the camera.

19. A thermal transfer printer according to claim 18, wherein the controller is arranged to control the camera to capture an image of the ribbon based upon said received output.

* * * * *